United States Patent [19]

Kimisawa

[11] Patent Number: 5,002,074

[45] Date of Patent: Mar. 26, 1991

[54] AUTOMOBILE ASHTRAY DEVICE

[75] Inventor: Toshihide Kimisawa, Yokohama, Japan

[73] Assignee: Nifco, Inc., Kanagawa, Japan

[21] Appl. No.: 456,927

[22] Filed: Dec. 26, 1989

[30] Foreign Application Priority Data

Dec. 26, 1988 [JP] Japan ..... 63-326060

[51] Int. Cl.[5] ..... A24F 19/00

[52] U.S. Cl. ..... 131/231; 296/37.9

[58] Field of Search ..... 131/231, 235.1, 237, 131/238, 239; 296/37.9, 37.12, 37.11

[56] References Cited

U.S. PATENT DOCUMENTS 4,355,836 10/1982 Iizuka ..... 131/231

4,720,131 1/1988 Grote ..... 296/37.9

FOREIGN PATENT DOCUMENTS 2917179 11/1979 Fed. Rep. of Germany ..... 131/231

6138476 11/1986 Japan .

*Primary Examiner*—V. Millin

*Assistant Examiner*—Lynne Reichard

*Attorney, Agent, or Firm*—Schwartz & Weinrieb

[57] ABSTRACT

An automobile ashtray device includes a housing open at the front end thereof, an ashtray body slidably disposed within the housing, a link mechanism including one pair of stays of equal length, a biasing device provided upon the link mechanism for elongating the link mechanism and biasing the ashtray body toward the opening of the housing, and a lock device for locking the ashtray body at an accommodated position within the housing against the biasing force of the biasing device. The stays are pivoted to each other in a manner having the configuration of the figure X and each of the stays has one end connected to the housing and the other end in contact with the ashtray body. The lock device is set releasable.

11 Claims, 4 Drawing Sheets

AUTOMOBILE ASHTRAY DEVICE

FIELD OF THE INVENTION

This invention relates to a sliding type automobile ashtray device for installation within the passenger compartment of an automobile.

DESCRIPTION OF THE PRIOR ART

A well-known sliding type automobile ashtray device comprises a housing open at the front, an ashtray body slidably held within the housing, biasing means for biasing the ashtray body toward the opening of the housing, brake means for attenuating the biasing force of the biasing means and lock means for locking the ashtray body within the housing against the biasing force of the biasing means, the lock means being releasable (as disclosed in, for instance, Japanese Utility Model Publication SHO 61-38476).

In this prior art ashtray device, the biasing force of the biasing means is transmitted to the ashtray body by utilizing a rack and pinion gearing system. Therefore, after the ashtray body has been removed so as to empty the cigarette butts and ashes, and/or trash that has been collected therein, it is necessary to mesh the rack and pinion in order to again mount the ashtray body back into the housing. The operations of mounting and dismounting the ashtray body are, therefore, cumbersome.

Furthermore, When the rack and pinion are utilized for transmitting the biasing force to the ashtray body, the rack must have a length substantially equal to the stroke of the ashtray body.

Thus since there is only limited space for installing the ashtray device within an automobile and part of this limited space is taken up by means of the rack, there is inevitably only sufficient space for installing an ashtray body of relatively small capacity.

Furthermore, if the ashtray body is pushed inwardly with unbalanced forces applied to its left and right sides, poor engagement between the rack and pinion is liable to occur because of the large length of the rack. In addition, if the rack is formed upon the bottom of the ashtray body, since the ashtray body is frequently removed from the housing so as to remove cigarette butts ashes, trash, and the like, the rack is likely to become clogged with ashes.

Still further, a spring or the like has to be used for driving the pinion. This tends to complicate the structure of the biasing means and increase the size thereof.

Furthermore, in the prior art device, the rack, pinion, biasing means, brake means and lock means are accommodated within a space defined between the bottom of the ashtray body and the bottom of the housing, thus imposing restrictions upon the design of the ashtray body, making its assembly difficult and limiting its capacity.

OBJECT OF THE INVENTION

The object of the present invention is to overcome the above problems inherent in the prior art by providing an automobile ashtray device wherein the ashtray body can be readily mounted and dismounted with respect to the housing, the ashtray body can be smoothly and easily moved with respect to the housing, and a large space for accommodating the ashtray body can be defined or provided within the housing.

SUMMARY OF THE INVENTION

In order to attain the above object of the invention, wherein an automobile ashtray device comprises a housing, an ashtray body slidably mounted within the housing, biasing means for biasing the ashtray body toward the opening of the housing, and lock means for locking the ashtray body at an accommodated position within the housing against the biasing force of the biasing means, the lock means being releasable, a link mechanism including at least one pair of stays of equal length and pivoted to each other in a cross-wise manner so as to have a configuration such as that of the FIG. X is provided between the housing and the ashtray body such that the biasing force of the biasing means is transmitted through the link mechanism to the ashtray body.

In accordance with the ashtray device constructed according to the present invention, when the ashtray body is accommodated within the housing, the link mechanism is disposed in a collapsed or folded state. When the locked state of the lock means (which may consist of a striker and a latch, for example is released, the link mechanism is elongated by means of the biasing force of the biasing means so as to push the ashtray body fowardly out of the housing. When removing the ashtray body from the housing it is only necessary to release the ashtray body from its coupled relation with the link mechanism. Thus, it can be readily removed from the housing, and it can also be readily mounted or installed back into the housing. Since the link mechanism is disposed in its folded state when the ashtray body is accommodated within the housing, the space occupied by the biasing means is reduced so that it is possible to accommodate an ashtray body of correspondingly increased size.

BRIEF DESCRIPTION OF THE DRAWINGS

The above and other features and objects of the invention will become apparent from the following detailed description when such is considered in connection with reference to the attached drawings, in which like reference characters designate like or corresponding parts throughout the several views, and wherein.

DETAILED DESCRIPTION OF THE PREFERRED EMBODIMENT

Figure 1:
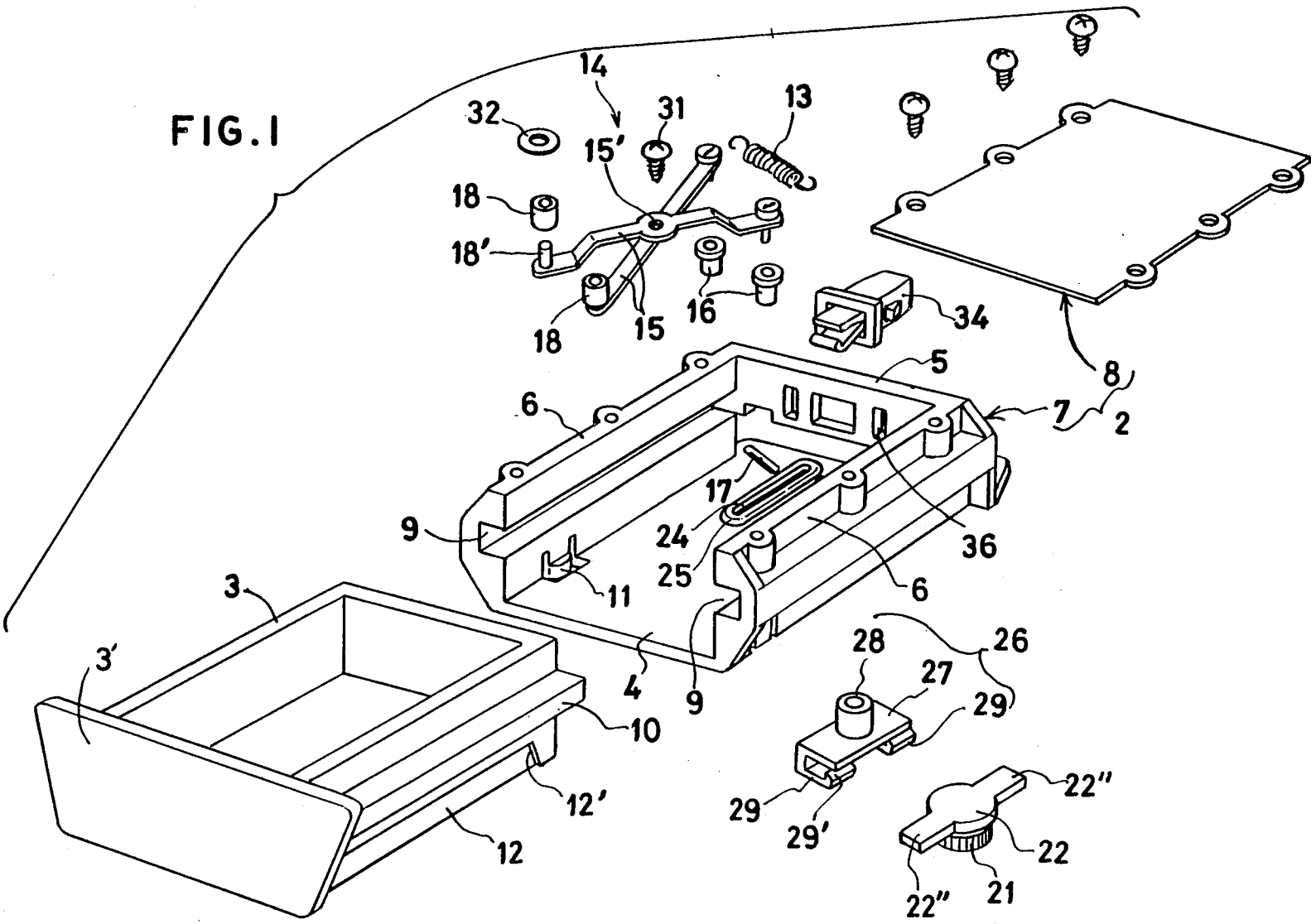
FIG. 1 is an exploded perspective view showing an embodiment of the automobile ashtray device according to the invention.

The drawings illustrate an embodiment of the automobile ashtray device constructed according to the present invention, which is generally designated by means of the reference numeral 1. The ashtray device 1 comprises a housing 2 which is open at the front, an ashtray body 3 slidably disposed within the housing 2, biasing means for biasing the ashtray body 3 toward the opening of the housing 2, braking means for attenuating the biasing force of the biasing means and lock means for locking the ashtray body 3 at an accommodated position within the housing 2 against the biasing force of the biasing means, the lock means being releasable.

Figure 2:
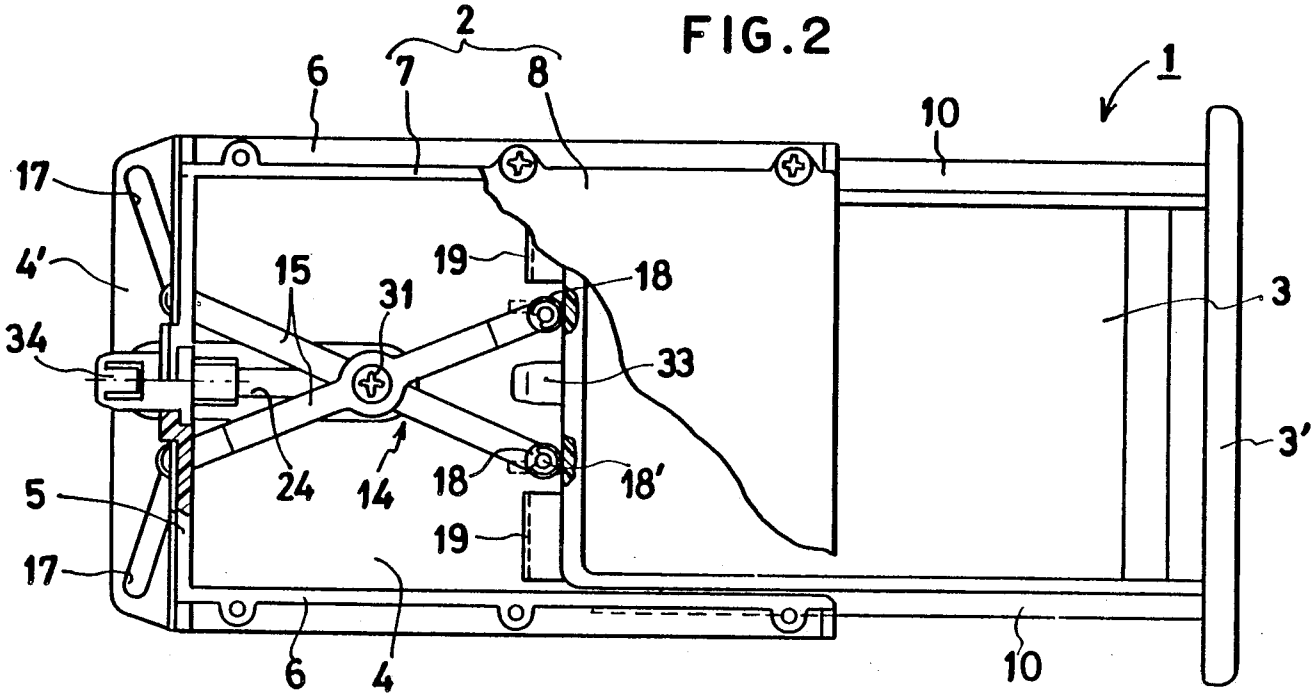
FIG. 2 is a plan view, partly broken away, showing the ashtray device of FIG. 1 with the ashtray body withdrawn from the housing.
Figure 3:
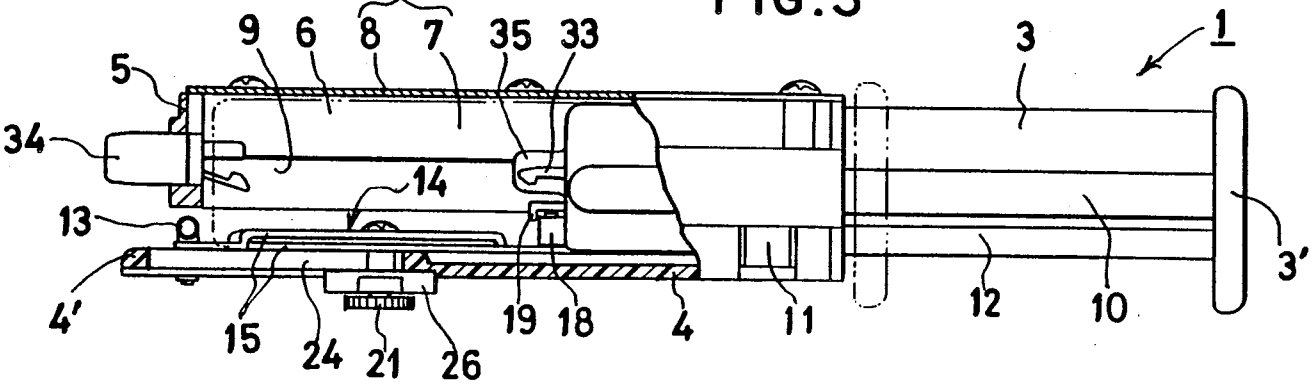
FIG. 3 is a side view, partly broken away, showing the ashtray device of FIG. 1 with the ashtray body withdrawn from the housing.
Figure 4:
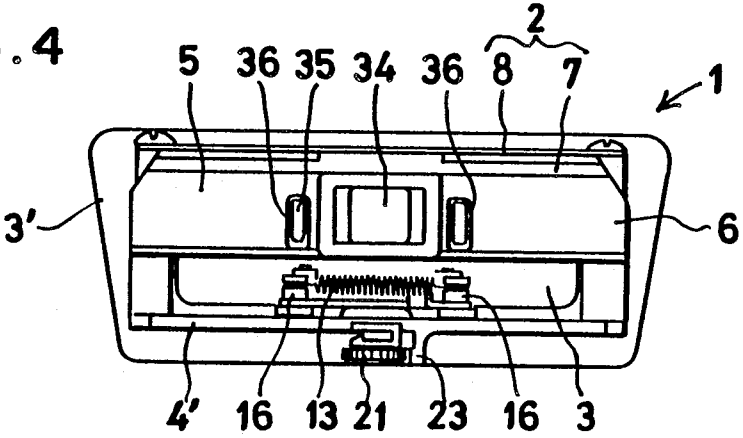
FIG. 4 is a rear view showing the ashtray device of FIG. 2 with the ashtray body withdrawn from the housing.

As shown in FIG. 1, the housing 2 has a wall 4, a rear wall 5 and left and right side walls 6. The housing 2 includes a housing body 7, which may be a plastic molding having heat-resistant properties, and a metal cover 8 closing the open top of the housing body 7. The cover 8 is secured by means of screws to the housing body 7 (FIGS. 2 to 4).

The ashtray body 3 has a size capable of being accommodated within a space defined by means of the housing body 7 and cover 8. At the front, the body has a flange 3' extending laterally across the open front of the housing body 7. It is a molding of a plastic material having high heat resistance.

The housing 2 and ashtray body 3 are provided with guide means of flanged and recessed shapes, respectively, fitting each other in the direction of slidable movement of the ashtray body 3. In the embodiment shown in FIG. 1, the opposite side walls 6 of the housing body 7 are provided upon their inner surfaces with a pair of slide grooves 9 extending in the sliding direction of the ashtray body 3, facing each other and open at the front ends thereof. On the other hand, the opposite side walls of the ashtray body 3 are formed upon the outer surfaces thereof with ridges 10 for engagement within the slide grooves 9.

Figure 5:
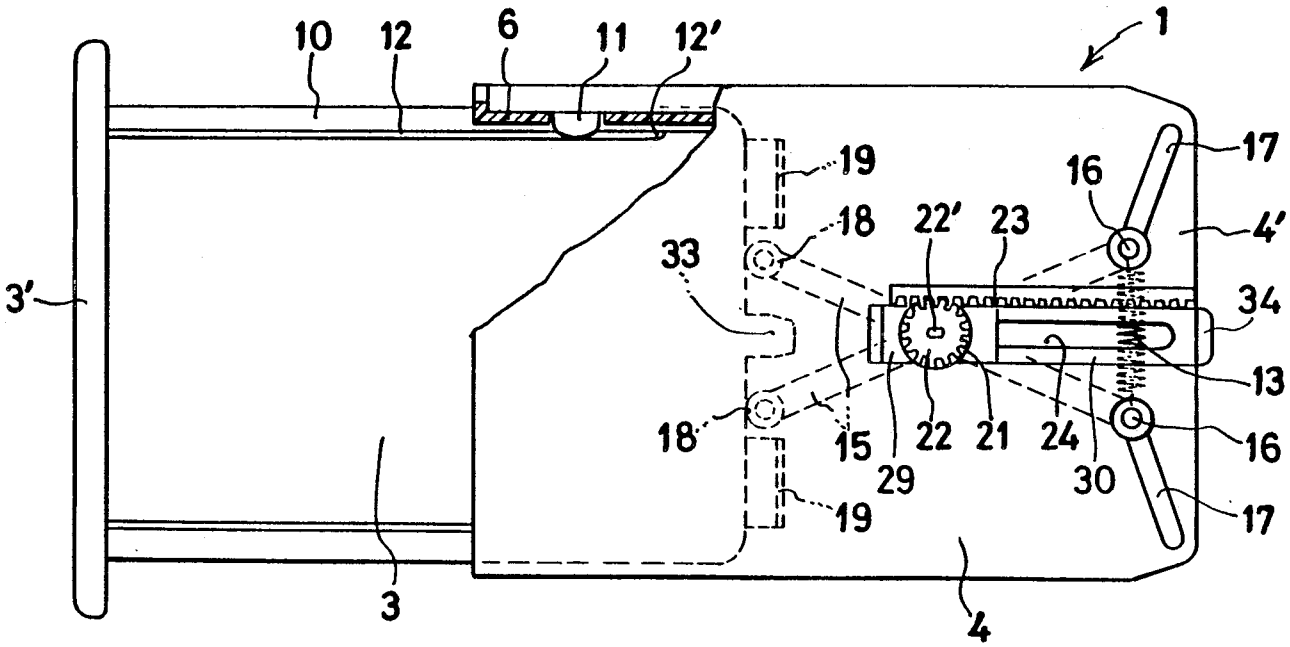
FIG. 5 is a bottom view, partly broken away, showing the ashtray device of FIG. 1 with the ashtray body withdrawn from the housing.

Furthermore, the housing and ashtray body 3 are provided with engaging means for preventing inadvertent detachment of the ashtray body 3 from the housing 2. In the illustrated embodiment, the opposite walls 6 of the housing body 7 are provided adjacent to the front end and at a lower portion within the housing 7, that is below the slide grooves 9, with a pair of elastic engagement pieces 11, as shown in FIGS. 1 and 5, which are each surrounded by means of a channel-shaped notch, and which are united at the upper end thereof to the side walls 6 and which face each other. On the other hand, the opposite side walls of the ashtray body 3 are provided at a lower portion, thereof, that is beneath the ridges 10, with a pair of notch grooves 12 for receiving the engagement pieces 11 which extend rearwardly from the rear surface of the flange 3' toward the opposite end of the body 3. A tapered protuberance 12' is formed at the end of each notch groove 12 remote from the flange 3'.

The biasing means for biasing the ashtray body 3 toward the opening of the housing 2 consists of a coil spring 13, the spring force of which is transmitted via a link mechanism 14 to the ashtray body 3.

As shown in FIG. 1, the link mechanism 14 includes a pair of stays 15 of equal length. These stays 15 intersect each other in a cross-wise manner so as to have a configuration like that of the FIG. X and are pivoted to each other at the intersection thereof. The coil spring 13 is stretched between the rear ends of the two stays 15, and its spring force biases the link mechanism 14 in an elongating direction (FIGS. 2 to 5).

A downwardly directed roller 16 is mounted by means of a pin upon the rear end of each stay 15. The bottom wall 4 of the housing body 7 is formed with a pair of guide slots 17 lying along the travel loci of the respective rollers 16. Each roller 16 is inserted from above into one guide slot 17 and is retained by means of an E ring or the like from the under side of the bottom wall 4 of the housing body 7. The rear wall 5 of the housing body 7 has a lower open portion, and the bottom wall 4 has a substantially trapezoidal rearward extension 4' in which the guide slots 17 are formed. With the rear wall 5 of the housing body 7 having the lower open portion and with the bottom wall 4 having the trapezoidal rearward extension 4', the rear portion of the link mechanism 14 can be located upon the rearward extension 4', thus increasing the space for accommodation of the ashtray body 3. It is alternatively possible to mount the rollers 16 such that they are directed upwardly and movable relative to the cover 8.

Figure 7:
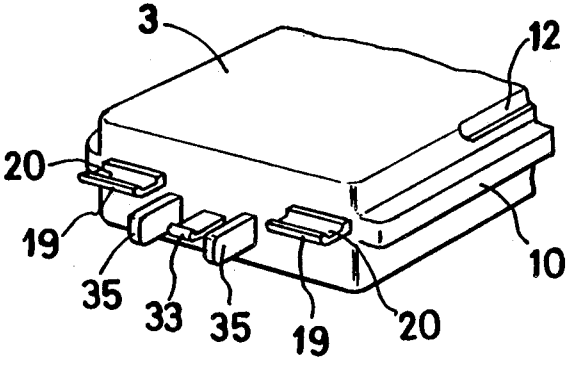
FIG. 7 is a rear perspective view showing the ashtray device shown in FIG. 1.

An upwardly directed roller 18 is mounted upon the front end of each stay 15. These rollers 18 engage the rear surface of the ashtray body 3. The rear surface of the ashtray body 3 is provided with a pair of, left and right, left and right, rearwardly extending L-shaped guide pieces 19 disposed upon left and right sides of the external rear wall of body 3 as best seen in FIG. 7. Each guide piece 19 has its laterally inner side formed with a guide groove 20 having a channel-shaped sectional profile open at the top and disposed opposite sides of the groove 20 for guiding a shaft 18' of the associated roller 18 (FIG. 7). The guide piece 19 has a smaller dimension than the travel locus of the shaft 18' of the roller 18, whereby the shaft 18' of the roller 18 detaches from the guide groove 20 when the link mechanism 14 is elongated.

As shown in FIGS. 1 and 5, the braking means includes a rotary damper 22 with a pinion 21 secured to a rotary shaft 22' and a rack 23 meshing with the pinion 21 of the rotary damper 22. The rotary shaft 22' of the rotary damper 22 is supported by means of the link mechanism 14 for rotation about the intersection axis of the link mechanism 14, and the rack 23 is provided upon the housing 2 such that it extends along or tangent to the locus of the intersection of the link mechanism 14.

The rotary damper 22 is an oil damper. In this embodiment, it is provided together with the rack 23 upon the back or under side of the bottom wall 4 of the housing body 7.

Figure 6:
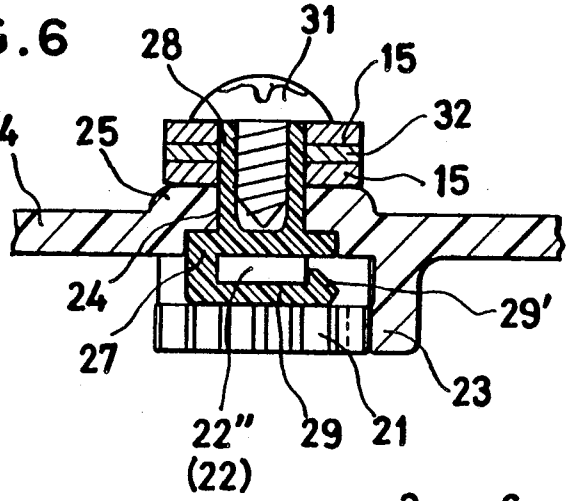
FIG. 6 is a fragmentary sectional view showing a bottom wall of the housing of the ashtray device shown in FIG. 1.

More specifically, as shown in FIG. 5, the bottom wall 4 of the housing body 7 is formed with a longitudinal slot 24 extending along the locus of the intersection of the stays 15, and the back or under side of the bottom wall 4 is integrally provided with the rack 23 so as to extend along one edge of the slot 24. Furthermore, the surface of the bottom wall 4 is preferably formed with an arcuate raised portion 25 surrounding the slot 24 so as to allow the stays 15 to be moved in a state slightly elevated above the surface of the bottom wall 4, thus reducing the frictional resistance between the stays 15 and the bottom wall 4 (FIG. 6).

Reference numeral 26 in FIG. 1 designates a holder for the rotary damper 22. The holder 26 is a one-piece molding of a plastic material and has a rectangular base 27, a cylindrical boss 28 extending upright from the upper surface of the base 27 and inserted through the slot 24 of the housing body 7, and a pair of holding pieces 29 extending from the opposite sides of the base 27 and having an L-shaped sectional profile. The back or under surface of the bottom wall 4 of the housing body 7 is formed with a shallow depression 30 having a size sufficient to receive the base 27 of the holder 26 and having a depth substantially equal to the thickness of the base 27, as shown in FIG. 5, whereby the holder 26 is able to be moved along the depression 30. Furthermore, the two stays 15 of the link mechanism 14 are formed at their intersection with holes 15', which are penetrated by means of the boss 28 of the holder 26.

Now, the procedure for mounting the rotary damper 22 will be described. First, the pinion 21 is secured to the shaft 22', and then with the pinion 21 directed downward a pair of mounting pieces 22" extending away from each other from the periphery of the rotary damper 22 are inserted laterally into the spaces defined between the base 27 and the holding pieces 29 of the holder 26 as a result of the elasticity of the pieces 29. With the mounting pieces 22" of the rotary damper 22 inserted in this manner, pawls 29' which provided at the ends of the holding pieces 29 are hooked upon the side surfaces of the mounting pieces 22", and the rotary damper 22 is securely mounted within the holder 26 (FIG. 6). Subsequently, the boss 28 of the holder 26 is passed upwardly through the slot 24 of the housing body 7. At this time, the pinion 21 of the rotary damper 22 mounted within the holder 26 is meshed with the rack 23. Subsequently the holes 15' of the stays 15 are disposed about the end portion of the boss 28 projecting upwardly through the slot 24 of the housing body 7, whereupon a tapping screw 31 is inserted into the boss 28 for retaining the stays within the housing assembly. A washer 32 is disposed upon the boss 28 of the holder 26 and interposed between the stays 15 so as to alleviate any frictional resistance between the stays 15.

The lock means includes a striker 33 and a double push type latch 34. When the striker 33 is pushed into the latch 34, the latch clamps and locks the striker 33. When the striker 33 is pushed further into the latch 34, it is released from the latch. As shown in FIG. 7, the striker 33 integrally is integral with body 3 and projects rearwardly from a substantially central portion of the rear surface of the ashtray body 3. As shown in FIGS. 1 to 4, the latch 34 is mounted in a substantially central portion of the rear wall 5 of the housing body 7 such that it projects or extends forwardly toward the striker 33. As an example of the double push type latch, there may be used any one of the latches disclosed in U.S. Pat. Nos. 4,749,949, 4,779,906, 4,616,861 or 4,657,291.

Upon opposite sides of the lock means is provided anti-rattling means for preventing lateral rattling of the ashtray body 3. In the illustrated embodiment, as shown in FIG. 7, the rear surface of the ashtray body 3 is provided with a pair of integral anti-rattling pieces 35 extending rearwardly upon the opposite sides of the striker 33 to an extent slightly greater than longitudinal extent of the striker 33, while, as shown in FIG. 1, the rear wall 5 of the housing body 7 is formed with left and right holes 36 for loosely receiving the anti-rattling pieces 35. As an alternative arrangement, anti-rattling pieces 35 may be provided such that they extend forwardly from the rear wall 5, of the housing 7, while forming associated holes 36 within the rear wall of the ashtray body 3. Furthermore, it is possible to form grooves or projections similar to the anti-rattling pieces 35 in lieu of the holes 36.

The operation of the ashtray device 1 which is constructed and assembled in the above manner will now be described.

Figure 8:
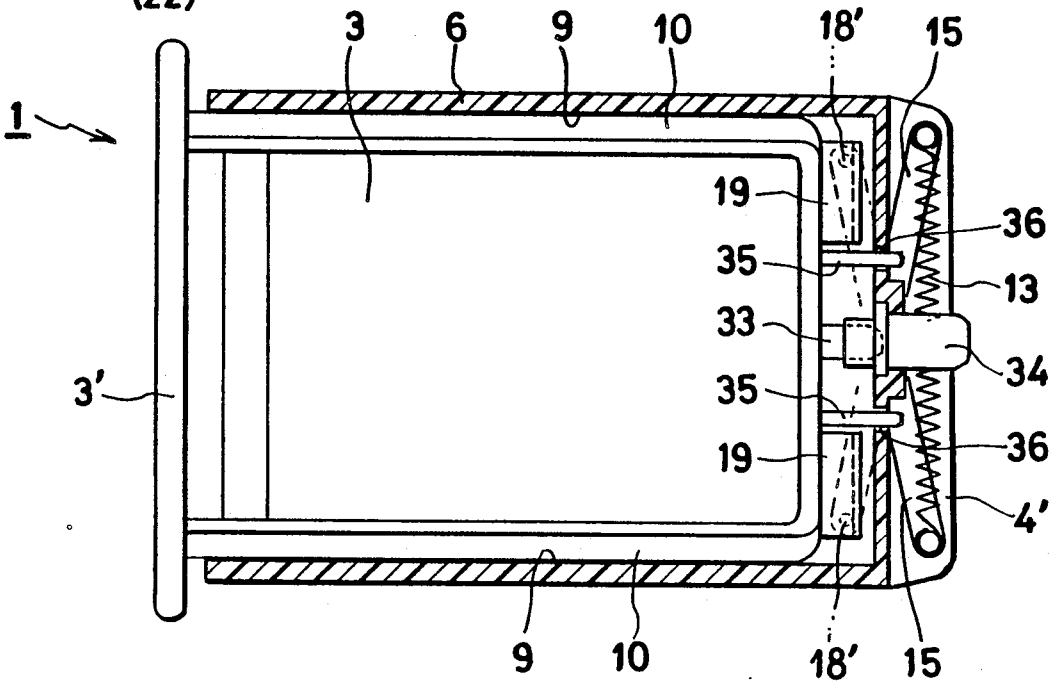
FIG. 8 is a plan view, partly broken away, showing the ashtray device of FIG. 1 with the ashtray body accommodated within the housing.

When withdrawing the ashtray body 3 from the accommodated state as shown in FIG. 8 for use, the front surface of its flange 3' is pushed slightly inwardly. This causes the latch 34 to be pushed by means of the striker 33, and thus the striker 33 is released from the locked state by means of the latch 34.

As a result, the distance between the rear ends of the two stays 15 is reduced by means of the restoring force of the coil spring 13. The link mechanism 14 is thus elongated, causing the rollers 18 at the end of the stays 15 to roll over the rear surface of the ashtray body 3 and toward each other so as to push the ashtray body 3 forwardly.

At this time, the position of the intersection of the link mechanism 14 is displaced forwardly so as to cause advancement of the boss 28 of the holder 26 along the slot 24. For this reason, the rotary damper 22 mounted upon the under surface of the bottom wall 4 of the housing body 7 is advanced in unison with the holder 26, thus causing rotation of the rotary shaft 22' of the rotary damper 22 since the pinion 21 is in mesh with the rack 23 (FIG. 5). Thus, the rotary damper 22 provides a dampening or braking force, and the ashtray body 3 is advanced quietly and slowly, as it is progressively projected outwardly from the housing body 7.

Meanwhile, the rollers 16 at the rear ends of the stays 15 advance along the associated guide slots 17 of the bottom wall 4 of the housing body 7, and when they strike the front end of the slots 17, the elongation of the link mechanism, 14 is stopped. At this time, the ashtray body 3 is disposed at the fully advanced position (FIGS. 2, 3 and 5).

In order to accommodate the ashtray body 3 previously projected outer of body, 7 back within the housing body 7, the front surface of the flange 3' of the ashtray body 3 is pushed toward the housing 2.

This causes the rollers 18 at the front end of the stays 15 to be pushed by means of the rear surface of the ashtray body 3, causing the link mechanism 14 to contract in a folding fashion so as to increase the distance between the front ends of the stays 15. The coil spring 13 is thus elongated so as to store the biasing or restoring force.

When the striker 33 of the ashtray body 3 eventually engages the latch 34 mounted upon the rear wall 5 of the housing body 7, it is clamped and latched by means of the latch 34, thus locking the ashtray body 3 at an accommodated position within the housing 2 against the restoring force of the coil spring 13 (FIG. 8). In order to release the ashtray from the locked state, the ashtray body 3 is pushed slightly beyond the accommodated position, and accordingly a redundant space permitting such slight pushing of the ashtray body 3 from the accommodated position is provided or defined between the housing 2 and ashtray body 3.

When accommodating the ashtray body 3, the shaft 18' of each roller 18 at the end of each stay 15 is received laterally within the inner guide groove 20 of the associated guide piece 19 of the ashtray body 3 and is moved laterally along the guide groove 20. When the ashtray body 3 is at the accommodated position, the shaft 18' of the roller 18 is located within the guide groove 20 of the guide piece 19. Thus, it is possible to prevent detachment of the ashtray body 3 from the housing 2 when the vehicle is suddenly braked or is being driven uphill. Furthermore, when withdrawing the ashtray body 3 from the housing 2 the shaft 18' of each roller 18 can be guided by means of the guide groove 20 during the initial withdrawal stage, while, when the link mechanism 14 is fully elongated, the shaft 18' is detached from the guide groove 20, thus permitting removal of the ashtray body 3.

In order to remove the ashtray body 3, the ashtray body 3 disposed in the projected state is strongly pulled forwardly with one's fingers hooked upon its flange 3'. As a result, the engagement pieces 11 projecting into the housing body 7 are pushed laterally outwardly and retracted by means of the tapered protuberances 12' defined at the ends of the notch grooves 12 of the rear end of the ashtray body 3. Thus, the ashtray body 3 within the housing body 7 can be removed.

When mounting the ashtray body 3, the ashtray body 3 is inserted within the housing 2 through the front opening thereof with the slide grooves 9 and ridges 10 engaged with one another. Then, by strongly pushing the ashtray body 3 inwardly into body 7 the engagement pieces 11 within the housing body 7 are pushed laterally outwardly and retracted by means of the side surfaces of the ashtray body 3. When the engagement pieces 11 reach the notch grooves 12 of the ashtray body 3, they are snap-fitted within the notch grooves 12 by means of their restoring forces. Thus, even in its withdrawn state, the ashtray body 3 will not detach from the housing 2 when the vehicle is suddenly braked or is moving uphill.

When inserting the ashtray body 3, the anti-rattling pieces 35 projecting rearwardly from the rear surface of the ashtray body 3 are fitted within the holes 36 of the rear wall 5 of the housing body 7. Thus, lateral rattling of the ashtray body 3 is prevented, the striker 33 and latch 34 can be smoothly engaged with each other, and damage to the striker 33 and latch 34 by means of external forces can be prevented.

In the embodiment illustrated in the drawings, the housing 2 consists of the plastic housing body 7 and metal cover 8. However, it is possible to mold these parts integrally from a plastic material. Conversely, it is possible to fabricate the entire housing 2 from a metal material. Furthermore, the ashtray body 3 may be made from a metal material instead of plastic.

Still further, while a pair of stays 15 of equal length are pivoted to each other in the manner of the figure X so as to construct the link mechanism 14, it is alternatively possible to employ a link mechanism having a pantagraph-like structure using an increased number of stays 15.

Yet further, while the brake means is constructed as comprising the rotary damper 22 with the pinion 21 secured to the shaft 22' and the rack 23 meshing with the pinion 21 of the rotary damper 22, the rotary damper 22 need not be of the oil type, and it is possible to use a governer or the like instead. Furthermore, the rotary damper 22 may be replaced with a piston-cylinder assembly or the like. Still, yet further the rack 23 and pinion 21 need not be used. For instance, when employing a piston-cylinder type damper, the piston rod may be directly coupled to the link mechanism 14.

Furthermore, the lock means is not limited to the arrangement consisting of the striker 33 and latch 34. For instance, it is possible to use an arrangement consisting of a pin and a hook hooked up on the pin or an arrangement consisting of a pin and a heart-shaped cam groove traced by means of the pin. Furthermore, it is possible to externally mount lock release means. Further, upon occurrence of an accident or very sudden braking, upon momentum acts on the ashtray body 3 and it is possible that the accommodate ashtray body 3 may be pushed inwardly further from its normal accommodated state so as to undesirably release the lock of the lock means. Accordingly, safety means may be provided upon the lock means or between the housing body 7 and the ashtray body 3 so as to prevent the ashtray body 3 from being projected in the above circumstances.

As has been described in the foregoing, with the construction according to the invention the ashtray body can be readily inserted and withdrawn. In addition, since the link mechanism is accommodated in a folded state when the ashtray body is accommodated in within the housing, it is possible to ensure a comparatively large space for accommodating the ashtray body within the housing. Furthermore, since the stays of the link mechanism are equal in length, the biasing force of the biasing means is equally transmitted to the left and right sides of the ashtray body. Moreover, even if the ashtray body is pushed by inwardly by means of the application of unbalanced forces upon the left and right sides there of, it will nevertheless be accommodated smoothly and easily in a balanced mode since the stays are abutted against the rear surface of the ashtray body at two places or locations relative thereto.

Furthermore, since the rotary shaft of the rotary damper is rotated upon the axis of the intersection of the link mechanism, equal braking forces can be applied to the left and right sides thereof. Still further, it is possible to use a rack having a small length as compared to the extent of movement of the ashtray body, and the ashtray body accommodation space in within the housing is not affected by mean of the rotary damper or rack. Obivously, many modifications and variations are possible in light of the above teachings. It is therefore to be understood that within the scope of the appended claims, the present invention may be practiced otherwise than as specifically described herein.

What is claimed is:

1. An automobile ashtray device, comprising:

a housing open at the front end thereof;

an ashtray body slidably disposed within said housing a link mechanism including at least one pair of stays of equal length, said stays being pivoted to each other in such a manner so as to have a configuration of that of the FIG. X wherein each stay has one end connected to said housing and the other end in contact with said ashtray body;

biasing means provided upon said link mechanism for elongating said link mechanism and biasing said ashtray body toward said open end of said housing; and releasable lock means for locking said ashtray body at an accommodated position within said housing against the biasing force of said biasing means.

2. An automobile ashtray device according to claim 1, further comprising brake means including a rotary damper provided at the intersection of said stays of said link mechanism, a pinion provided up on a rotary shaft of said rotary damper, and a rack provided up on said housing along a movement locus of said intersection of said link mechanism and in mesh with said pinion.

3. An ashtray device as set forth in claim 1, further comprising longitudinally extending, oppositely disposed recess groove defined within opposite sidewalls of said housing; and ridge means extending laterally outwardly from opposite sides of said ashtray body for slidable engagement within said recess grooves of said housing for slidably guiding said ashtray within said housing during insertion and withdrawal of said ashtray into and out from said housing.

4. An ashtray device as set forth in Claim 1, further comprising:

groove means defined upon opposite side walls of said ashtray body and extending longitudinally with respect to said ashtray body;

flexible engagement means mounted upon opposite sidewalls of said housing for relative slidable movement within said groove means of said ashtray body; and protuberance means defined upon said sidewalls of said ashtray body and at rear end portion of said groove means for engaging said engagement means of said housing so as to prevent withdrawal of said ashtray from said housing when said ashtray is moved a first predetermined extent out from said housing, and for causing flexible retraction of said engagement means into said sidewalls of said housing so as to permit said ashtray to be removed from said housing when said ashtray is moved a second predetermined extent out from said housing beyond said first predetermined extent.

5. An ashtray device as set forth in Claim 1, wherein:

said biasing means comprises a coil spring interconnecting one end of each of said pairs of stays.

6. An ashtray device as set forth in Claim 5, wherein:

said one end of each of said stays is the rear end of each of said stays.

7. An ashtray device as set forth in Claim 6, further comprising:

latterally extending slot means defined within a bottom wall of said housing for accommodating said rear ends of said stays during elongation and contraction of said stays as said ashtray body is projected outwardly from, or inserted into, said housing under the influence of, and against, the biasing force of said biasing means, respectively.

8. An ashtray device as set forth in Claim 2, further comprising:

longitudinally extending slot means defined within a bottom wall of said housing for accommodating said intersection of said stays as said intersection of said stays moves along said locus during movement of said ashtray body into and out from said housing.

9. An ashtray device as set forth in Claim 1, further comprising:

channel-shaped guide means mounted upon opposite sides of said ashtray body for engaging said other ends of said stays when said ashtray body is partially inserted within said housing so as to retain said ashtray body within said housing, and for disengaging said other ends of said stays when said ashtray body is fully projected out from said housing so as to permit withdrawal of said ashtray body from said housing.

10. An ashtray device as set forth in Claim 1, wherein said releasable lock means comprises:

a striker mounted upon a rear wall of said ashtray body; and double push-type latch means mounted upon a rear wall of said housing for retaining and releasing said striker.

11. An ashtray device as set forth in Claim 1, further comprising:

anti-rattling means projecting longitudinally outwardly from a rear wall portion of said ashtray body; and aperture means defined within a rear wall portion of said housing for receiving said anti-rattling means of said ashtray body when said ashtray body is fully inserted within said housing so as to prevent lateral rattling of said ashtray body within said housing.

* * * * *